US005242042A

United States Patent [19]

Mauldin

[11] Patent Number: 5,242,042

[45] Date of Patent: Sep. 7, 1993

[54] ESCALATOR HAVING LATERAL SAFETY BOUNDARIES

[75] Inventor: David E. Mauldin, Oakland, N.J.

[73] Assignee: Inventio AG, Hergiswil, Switzerland

[21] Appl. No.: 993,428

[22] Filed: Dec. 21, 1992

[51] Int. Cl.[5] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 3,616,891 | 2/1971 | Earle | 198/333 |
| 3,986,595 | 10/1976 | Asano et al. | 198/333 |
| 4,236,623 | 12/1980 | Ackert | 198/333 |
| 4,362,232 | 12/1982 | Saito et al. . | |
| 4,397,383 | 8/1983 | James | 198/333 |
| 4,413,719 | 11/1983 | White | 198/333 |
| 4,519,490 | 5/1985 | White | 198/333 |
| 4,529,490 | 5/1985 | White . | |
| 4,570,781 | 2/1986 | Kappenhagen | 198/333 |
| 4,858,745 | 8/1989 | Haas et al. | 198/333 |
| 4,984,672 | 1/1991 | Saito et al. | 198/333 |
| 5,082,102 | 1/1992 | Reichmuth | 198/333 |

FOREIGN PATENT DOCUMENTS

| | | | |
|---|---|---|---|
| 0297233 | 1/1989 | European Pat. Off. . | |
| 2-265894 | 10/1990 | Japan | 198/333 |
| 1276922 | 6/1972 | United Kingdom | 198/333 |

*Primary Examiner*—Robert P. Olszewski
*Assistant Examiner*—Cheryl L. Gastineau
*Attorney, Agent, or Firm*—William J. Clemens

[57] ABSTRACT

An escalator is formed of a plurality of steps traveling in a continuous conveyor between a pair of spaced apart skirt plates. Each step has lateral safety boundaries attached to the side edges thereof. Spring inserts are positioned between the outermost ribs of the tread plate and the riser of the step to maintain the safety boundaries in contact at all times with the skirt plates. Thus, differences in the distance between the skirt plates and deviations of the travel path of the steps are equalized and the air gaps between the skirt plates and the side edges of the steps are closed at all times. The material from which the safety boundaries are made is selected to provide the lowest possible friction losses and to prevent scraping noises during operation. However, the safety boundaries will wear down before the skirt plates and worn out safety boundaries can be replaced without having to dismantle the corresponding step from the step conveyor.

20 Claims, 3 Drawing Sheets

Fig.1
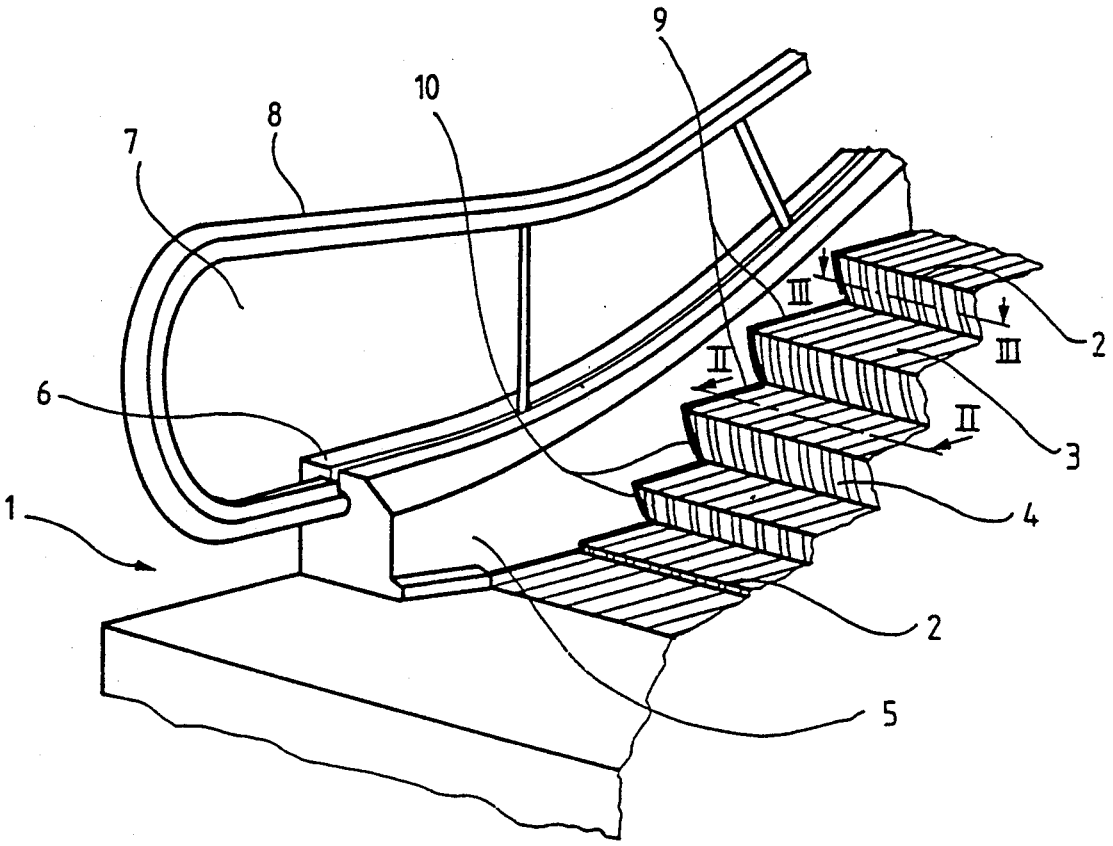
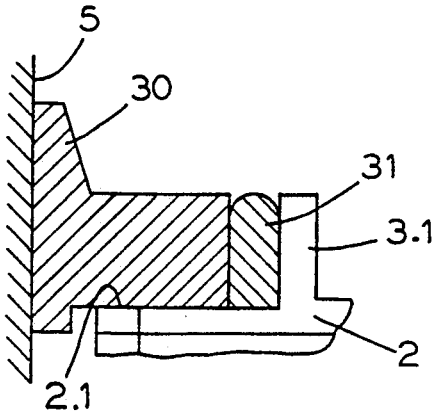
Fig.10

ESCALATOR HAVING LATERAL SAFETY BOUNDARIES

BACKGROUND OF THE INVENTION

The present invention relates generally to an escalator and, in particular, to lateral safety boundaries for continuous step escalators.

It long has been a goal of escalator manufacturers to counter the known latent danger of the catching of clothing or shoes between the traveling steps and the stationary skirt plates of escalators. National regulations prescribe a minimum safety precaution to keep the distance between the edge of a movable step and the adjoining skirt plate as small as possible, for example, the maximum distance at one side must not exceed 4 mm. This requirement is relatively difficult to maintain since certain inaccuracies cannot be excluded, due on the one hand to the plurality of movable steps which are aligned in an endless conveyor and due on the other hand to the skirt plates which are formed in lengths and fixed end-to-end adjacent to the path of travel of the conveyor. Both the step and the skirt plates are subject to manufacturing and installation tolerances.

An escalator is shown in the European patent document no. 0 297 233 in which each individual step has lateral safety boundaries which are supported in such a way that the outermost rib of the safety boundary, upon loading by a traveler, comes to rest on the skirt plate. The gap between the outermost rib of this step and the skirt plate is thereby locally closed, while this outermost rib slides along the skirt plate during the travel of the step conveyor. The disadvantage of this invention is that the gap between the individual steps and the skirt plate is only closed in those places where a traveler steps on the lateral edge of the tread plate or presses by some other forced action against the edge of the riser of a step.

Another similar safety device for escalators is shown in the U.S. Pat. No. 4,413,719 in which the lateral gap between the terminal ribs of the movable steps and the stationary skirt plates is completely closed by elastic synthetic material inserts. Since the gaps between the lateral edges of the traveling step conveyor and the stationary skirt plates vary, due to manufacturing and installation inaccuracies, a disadvantage of this device is that the sliding synthetic material inserts adjoining the skirt plates are pressed together more or less strongly which causes frictional losses and undesirable whistling or hissing noises.

SUMMARY OF THE INVENTION

The present invention concerns a safety apparatus for an escalator with a traveling endless step conveyor having steps which include lateral safety boundaries. The safety boundaries are mounted as inserts on the body of the steps to form a visible indication of the border zones and to at least temporarily close the air gap between the side edge of the step and the skirt plate.

The invention is based on the problem of providing a safety apparatus for the lateral edges of each step of an escalator, which safety apparatus always closes the air gap between the side edges of the step and the skirt plate and glides with little effort along the skirt plate. At the same time, the safety apparatus must equalize inaccuracies which can arise between the stationary skirt plates and the moving step conveyor.

According to the present invention, the left and right side edges of the tread plate and the left and right side edges of the riser of each individual step are equipped with slidably supported safety boundaries. With the aid of a spring insert positioned between the outermost ribs of the steps and the safety boundaries, the safety boundaries are maintained gently in contact with the skirt plate. During the travel of the step conveyor, the safety boundaries glide along the skirt plates and move toward and away from the skirt plates as the gap changes. The safety boundaries can be retained and guided in their movements by fasteners attached to the step and engaging slots or apertures formed in the safety boundaries, or by interlocking profile guides such as a dovetail joint. In the alternative, the spring inserts can be formed of a relatively low durometer material and attached to the corresponding safety boundary.

The advantages realized by the present invention are that the dangerous air gap between the traveling step conveyor and the skirt plates is closed at all times, that normal inaccuracies between the traveling step conveyor and the skirt plates are equalized, that frictional losses which are generated by the safety boundaries slidingly adjoining the skirt plate can be kept so small as to be neglected and that no sliding contact noises will occur. Thus, the safety apparatus according to the present invention does not guide the step conveyor laterally, but rather permits the steps to follow their normal course and equalizes the lateral tolerance which varies within small limits in order to assure that this gap always remains closed. The material of the safety boundaries can be chosen to be wear resistant, but also so that the more easily exchangeable safety boundaries are worn down before the skirt plates are worn. The present invention is suitable for updating existing older escalator installations which exhibit gaps between the steps and the skirt plates which are no longer in accordance with regulations.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a fragmentary perspective view of a section of an escalator showing the steps and the safety boundaries according to the present invention arranged on the side edges of the steps;

FIG. 10 is an elevation view, similar to the FIG. 2, of a third alternate embodiment of a safety boundary according to the present invention.

DESCRIPTION OF THE PREFERRED - EMBODIMENT

Figure 2:
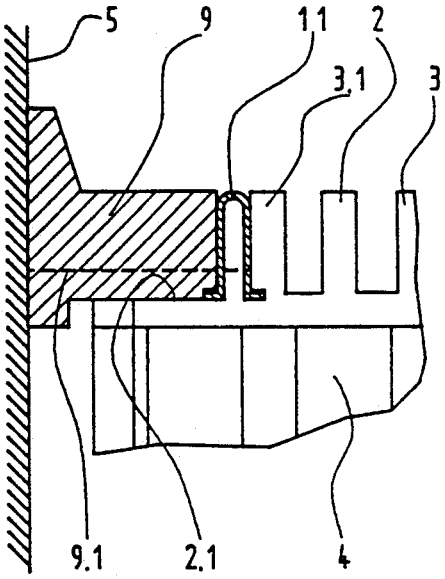
FIG. 2 is an enlarged, fragmentary, cross-sectional elevation view of an escalator step tread plate view taken along the line II—II in the FIG. 1.

Illustrated in the FIG. 1 is a section of an escalator 1 in a region of a lower entrance to the escalator. The escalator 1 includes a plurality of steps 2 which are connected together as endlessly circulating step conveyor positioned between a pair of spaced apart, generally parallel skirt plates 5 each capped by a balustrade retainer 6. Mounted on each of the balustrade retainers 6 is a vertically extending balustrade 7 on which an endless rubber handrail 8 moves synchronously with the step conveyor. Each of the steps 2 is formed by a generally horizontally extending tread plate 3 and a curved riser 4 extending generally vertically downward from a forward edge of the tread plate. On each side edge of the tread plate 3, a safety boundary 9 is provided as a termination adjacent the corresponding skirt plate 5. In the same manner, similar, correspondingly curved safety boundaries 10 are arranged at each side edge of the riser 4.

As shown in the FIG. 2, the safety boundary 9 is mounted in a recess 2.1 formed in an upper surface of the tread plate 3 of the step 2 and is free to slide toward and away from the adjacent skirt plate 5. The tread plate 3 has a plurality of ribs formed on its upper surface extending in the direction of travel of the steps 2. Positioned between a last or outer rib 3.1 of the tread plate 3 and a facing end of the safety boundary 9 is a generally U-shaped spring insert 11 formed of an elastic material. The insert 11 exerts a lateral force to maintain the safety boundary 9 gently in contact with the skirt plate 5.

Figure 3:
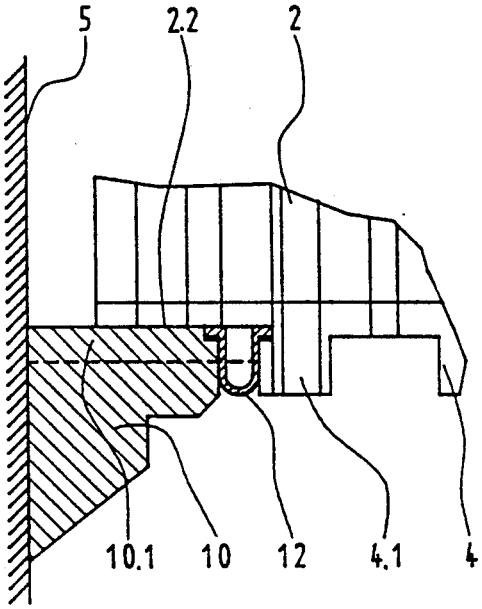
FIG. 3 is an enlarged, fragmentary, cross-sectional plan view of an escalator step riser taken along the line III—III in the FIG. 1.

Illustrated in the FIG. 3 is the safety boundary 10 mounted in a recess 2.2 formed in a front surface of the riser 4 of the step 2. The safety boundary 10 is free to slide toward and away from the adjacent skirt plate 5. The riser 4 has a plurality of ribs formed on its front surface extending in the direction of travel of the steps 2. Positioned between a last or outer rib 4.1 of the riser 4 and a facing end of the safety boundary 10 is a generally U-shaped spring insert 12 formed of an elastic material. The insert 12 exerts a lateral force to maintain the safety boundary 10 gently in contact with the skirt plate 5.

Figure 4:
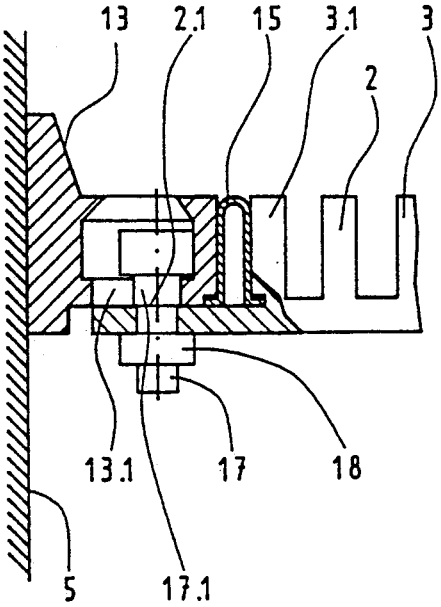
FIG. 4 is an elevation view, similar to the FIG. 2, of a tread plate and a first alternate embodiment of a safety boundary according to the present invention.
Figure 5:
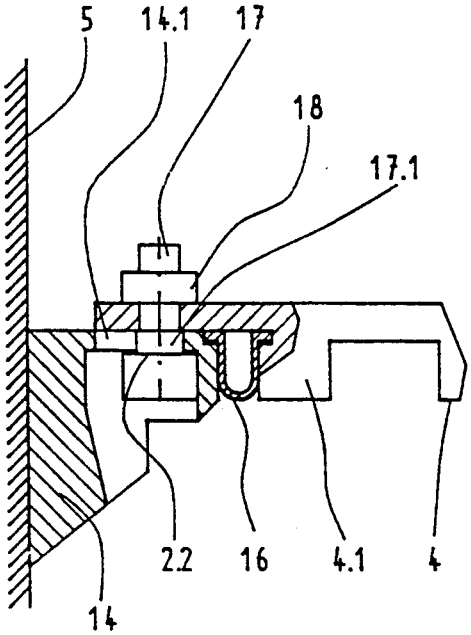
FIG. 5 is a plan view, similar to the FIG. 3, of a riser and the safety boundary shown in the FIG. 4.

There is shown in the FIGS. 4 and 5 an alternate embodiment of a safety boundary according to the present invention. A pair of safety boundaries 13 and 14 are positioned in the recesses 2.1 and 2.2 respectively of the tread plate 3 and the riser 4 respectively. A pair of threaded fasteners 17 are mounted in apertures formed in the bottom walls of the recesses 2.1 and 2.2 and extend longitudinally transverse to the lateral direction of displacement of the safety boundaries 13 and 14. Each of the fasteners 17 is retained in the associated aperture by a nut 18. The heads of the fasteners 17 are precisely spaced from the bottoms of the recesses 2.1 and 2.2 by stepped shanks 17.1 which extend through and cooperate with oblong slots or apertures 13.1 and 14.1 formed in the safety boundaries 13 and 14 respectively. The fasteners 17 retain the safety boundaries in the recesses 2.1 and 2.2 respectively and also guide the movement of the safety boundaries toward and away from the skirt plates 5. A pair of spring inserts 15 and 16 are positioned between the outermost ribs 3.1 and 4.1 respectively and the safety boundaries 13 and 14 respectively to gently urge the safety boundaries against the skirt plate 5 and thereby maintain the safety boundaries in contact with the skirt plate 5 to close the air gap between the step 2 and the skirt plate 5 during rest and operation of the escalator 1.

Figure 6:
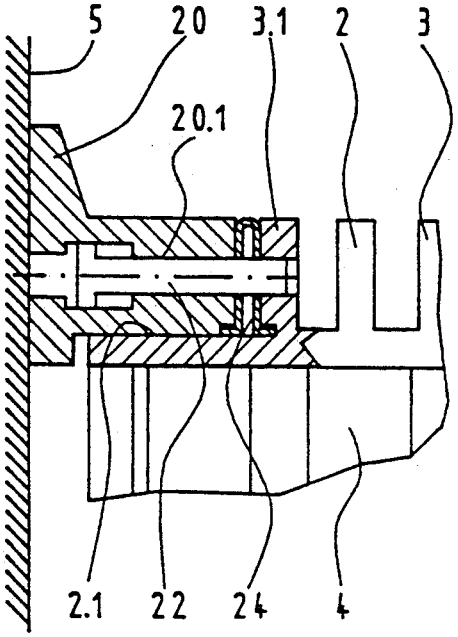
FIG. 6 is an elevation view, similar to the FIG. 2, of a tread plate and a second alternate embodiment of a safety boundary according to the present invention in a compressed condition.
Figure 7:
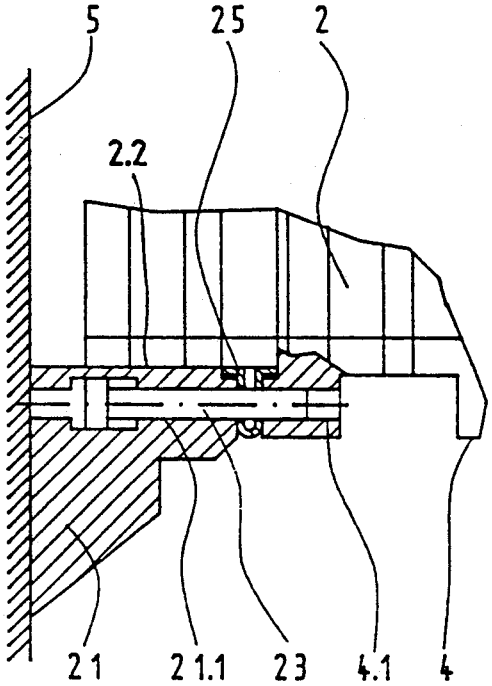
FIG. 7 is a plan view, similar to the FIG. 3, of a riser and the safety boundary shown in the FIG. 6.
Figure 8:
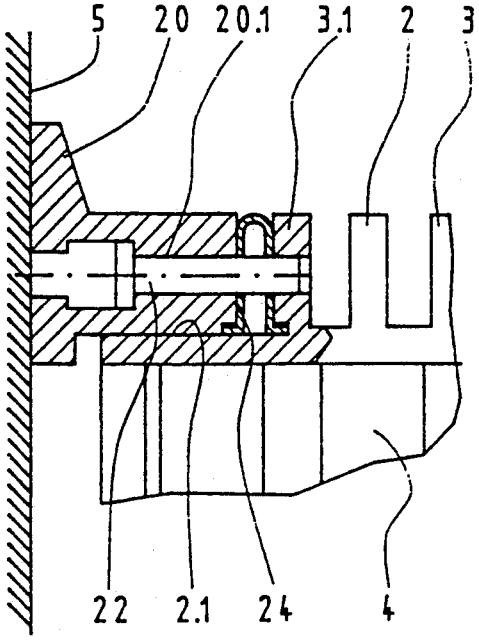
FIG. 8 is an elevation view of the tread plate and the safety boundary shown in the FIG. 6 in a lightly prestressed condition.
Figure 9:
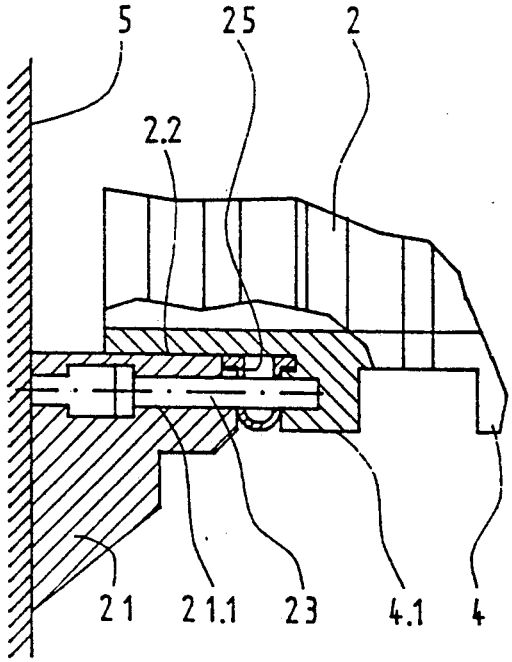
FIG. 9 is a plan view of the riser and the safety boundary shown in the FIG. 7 in a lightly prestressed spring insert.

A second alternate embodiment of a safety boundary according to the present invention is shown in the FIGS. 6 through 9. A pair of safety boundaries 20 and 21 are positioned in the recesses 2.1 and 2.2 respectively. A pair of threaded fasteners or shoulder studs 22 and 23 extend longitudinally parallel to the direction of displacement of the safety boundaries 20 and 21 respectively. A threaded end of each of the shoulder studs 22 and 23 engages a corresponding threaded aperture formed in one of the outermost ribs 3.1 and 4.1 respectively of the step 2. A shank of each of the shoulder studs 22 and 23 extends through a corresponding one of a pair of apertures 20.1 and 21.1 respectively formed in the safety boundaries 20 and 21 respectively. The shoulder studs 22 and 23 retain the safety boundaries in the recesses and function as guides for the movement of the safety boundaries 20 and 21 respectively toward and away from the skirt plates 5. A central portion of the apertures 20.1 and 21.1 can be enlarged in diameter to form end walls which retain and cooperate with the heads of the shoulder studs 22 and 23 respectively to limit the innermost and outermost positions of the slidably supported safety boundaries 20 and 21 respectively. A pair of generally U-shaped spring inserts 24 and 25 are positioned between the outermost ribs 3.1 and 4.1 respectively and the safety boundaries 20 and 21 respectively to bias the safety boundaries gently into contact with the skirt plate 5 to thereby close the air gap between the edge of the step 2 and the skirt plate 5 during rest and operation of the escalator 1. The FIGS. 6 and 7 show completely compressed spring inserts 24 and 25 respectively where the gap between the step 2 and the skirt plate 5 is the narrowest. The FIGS. 8 and 9 show completely extended spring inserts 24 and 25 respectively where the gap is the widest between the step 2 and the skirt plate 5.

The escalator 1 described above includes a step conveyor with a plurality of steps circulating endlessly in a supporting body, which steps are connected in a hinged or articulated manner at opposite side edges with an endless step-chain. The step conveyor is returned by way of upper drive sprocket wheels and lower guide sprocket wheels and has an exposed lead with a lower horizontal portion, an upper horizontal portion and a connecting inclined portion. A return travel portion is covered or hidden in the supporting body. The lead of the step conveyor is positioned between two lateral hand-rail balustrades and is guided past a pair of parallel fixed skirt plates. Conventional escalators have an air gap on both sides between the traveling step conveyor and the stationary skirt plates. This air gap must not exceed a certain prescribed width, but can vary slightly within this value, depending on the precision of travel of the step conveyor and the accuracy of assembly of the skirt plates.

According to the present invention, the left and right side edges of the tread plate and the left and right side edges of the riser of each individual step are equipped with slidably supported safety boundaries. With the aid of a spring insert positioned between the outermost ribs of the steps and the safety boundaries, the safety boundaries are maintained gently in contact with the skirt plate. During the travel of the step conveyor, the safety boundaries glide along the skirt plates, equalize deviations in the path of travel of the step edges and inaccuracies of assembly of the skirt plates, and close at all times the air gap on both sides of the step conveyor without causing large frictional losses or scraping noises. Thus, the risk of trapping objects between the side edges of traveling step and the stationary skirt plates is practically eliminated.

Instead of enabling lateral displacement of the safety boundaries through the use of the fasteners 17, 22 and 23 illustrated in the FIGS. 4 through 9, other forms of sliding connections can be utilized. For example, as shown in the FIGS. 2 and 3, it is possible to provide interlocking profile guides slidably coupling the safety boundaries to the step. The guides are in the form of a pair of dovetail joints 9.1 and 10.1 which are formed on the tread plate 3 and the riser 4 respectively and on the safety boundaries 9 and 10 respectively. The mortise can be formed on one of the safety boundary and the step with the cooperating tenon formed on the other one of the safety boundary and the step.

There is shown in the FIG. 10 a third alternate embodiment of a safety boundary according to the present invention. A safety boundary 30 is positioned in the recess 2.1 and is formed of a relatively higher durometer material which is flexible but not easily compressible. A spring insert 31 is positioned between the outermost rib 3.1 and the safety boundary 30 to bias the safety boundary gently into contact with the skirt plate 5 to thereby close the air gap between the edge of the step 2 and the skirt plate 5 during rest and operation of the escalator 1. The spring insert 31 can be formed of a relatively lower durometer resilient material which can be compressed and will return to its free shape when a compressing force is removed. The spring insert 31 can be attached to the safety boundary 30 by any suitable means such as an adhesive or being molded onto the safety boundary.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety apparatus for an escalator having a traveling endless step conveyor guided between a pair of generally parallel spaced apart skirt plates, the conveyor including a plurality of steps each having side edges adjacent to and spaced from a corresponding one of the skirt plates by an air gap and safety boundaries positioned on the steps to form a visible indication of the step side edges and to close at least temporarily the air gap between the step side edges and the skirt plates, the safety apparatus comprising: at least one safety boundary mounted at a side edge of a conveyor step and being slidably movable toward and away from an adjacent skirt plate, and a spring insert mounted on the step and engaging said safety boundary for maintaining said safety boundary in contact with the skirt plate when the step is at rest and when the step is moving.

2. The safety apparatus according to claim 1 wherein said safety boundary has a slot formed therein extending longitudinally in the direction of movement of said safety boundary toward and away from the skirt plate and including a fastener attached to the step and extending through said slot for guiding said movement said safety boundary.

3. The safety apparatus according to claim 2 wherein said safety boundary is positioned in a recess formed in the step and said fastener threadably engages a bottom wall of the recess and has a stepped shank extending through said slot for locating a head of said fastener with respect to the bottom wall of the recess.

4. The safety apparatus according to claim 1 wherein said safety boundary has an aperture formed therein having a longitudinal axis extending in the direction of movement of said safety boundary toward and away from the skirt plate and including a shoulder stud extending through said aperture and threadably engaging an outer rib of the step for guiding the movement of said safety boundary.

5. The safety apparatus according to claim 4 wherein said aperture has a larger diameter center portion for retaining a head of said shoulder stud, said shoulder stud head abutting an end wall of said larger diameter center portion for limiting the movement of said safety boundary toward the skirt plate.

6. The safety apparatus according to claim 1 including an interlocking profile guide slidably coupling said safety boundary to the step.

7. The safety apparatus according to claim 6 wherein profile guide is a dovetail joint.

8. The safety apparatus according to claim 1 wherein said spring insert is generally U-shaped.

9. The safety apparatus according to claim 1 wherein said spring insert is formed of a relatively low durometer material.

10. The safety apparatus according to claim 9 wherein said spring insert is attached to said safety boundary.

11. A safety apparatus for an escalator having a traveling endless step conveyor guided between a pair of generally parallel spaced apart skirt plates, the conveyor including a plurality of steps each having a tread plate and a riser with side edges adjacent to and spaced from a corresponding one of the skirt plates by an air gap and safety boundaries positioned on the steps to form a visible indication of the step side edges and to close at least temporarily the air between the step side edges and the skirt plates, the safety apparatus comprising:

at least a pair of safety boundaries mounted on a conveyor step, one of said safety boundaries positioned at a side edge of a tread plate of the step and another one of said safety boundaries being positioned at a side edge of a riser of the step, said safety boundaries being slidably movable toward and away from an adjacent skirt plate; and at least a pair of spring inserts mounted on the step and each engaging one of said safety boundaries for maintaining said safety boundaries in contact with the skirt plate when the step is at rest and when the step is moving.

12. The safety apparatus according to claim 11 including a pair of fasteners attached to the step, each of said fasteners extending through an aperture formed in one of said safety boundaries for guiding the movement of and retaining said safety boundaries.

13. The safety apparatus according to claim 12 wherein said aperture is a slot extending longitudinally in the direction of the movement of said safety boundary toward and away from the skirt plate.

14. A safety apparatus for an escalator having a traveling endless step conveyor guided between a pair of generally parallel spaced apart skirt plates, the conveyor including a plurality of steps each having a tread plate and a riser with side edges adjacent to and spaced from a corresponding one of the skirt plates by and air gap and safety boundaries positioned on the steps to form a visible indication of the step side edges and to close at least temporarily the air gap between the step side edges and the skirt plates, the safety apparatus comprising:

at least two pairs of safety boundaries mounted on a conveyor step, one of said pairs of said safety boundaries positioned at opposite side edges of a tread plate of the step and another one of said pairs of said safety boundaries being positioned at opposite side edges of a riser of the step, said safety boundaries being slidably movable toward away from adjacent skirt plates; and at least two pairs of spring inserts mounted on the step, each of said spring inserts engaging one of said safety boundaries for maintaining said safety boundaries in contact with the skirt plate when the step is at rest and when the step is moving.

15. The safety apparatus according to claim 14 wherein each of said safety boundaries is positioned in a recess formed in the step and has a slot formed therein extending longitudinally in the direction of the movement of said safety boundary toward and away from the skirt plate and including a fastener for each of said safety boundaries attached to the step and extending through said slot for guiding said movement of said safety boundary, said fastener threadably engaging a bottom wall of the recess and having a stepped shank extending through said slot for locating a head of said fastener with respect to the bottom wall of the recess.

16. The safety apparatus according to claim 14 wherein each of said safety boundaries has an aperture formed therein having a longitudinal axis extending in the direction of movement of said safety boundary toward and away from the skirt plate and including a shoulder stud for each of said safety boundaries extending through said aperture and threadably engaging an outer rib of the step for guiding the movement of said safety boundary, said aperture having a larger diameter center portion for retaining a head of said shoulder stud, said shoulder stud head abutting an end wall of said larger diameter center portion for limiting the movement of said boundary toward the skirt plate.

17. The safety apparatus according to claim 14 including a dovetail joint slidably coupling each of said safety boundaries to the step.

18. The safety apparatus according to claim 14 wherein said spring inserts are generally U-shaped.

19. The safety apparatus according to claim 14 wherein said spring inserts are formed of a relatively low durometer material.

20. The safety apparatus according to claim 19 wherein said spring inserts are attached to said safety boundaries.

* * * * *